United States Patent [19]

Kryger

[11] 4,182,450

[45] Jan. 8, 1980

[54] PACKAGING APPARATUS FOR FRAGILE ARTICLES

[76] Inventor: W. M. Kryger, 300 W. 23rd Ave., North Kansas City, Mo. 64116

[21] Appl. No.: 919,383

[22] Filed: Jun. 26, 1978

[51] Int. Cl.[2] :..... B65D 85/48; B65D 81/06

[52] U.S. Cl. ..... 206/448; 52/DIG. 6; 85/13; 206/454; 206/586

[58] Field of Search ..... 206/448, 454, 586; 229/47; 52/DIG. 6; 85/13, 11; 217/70

[56] References Cited

U.S. PATENT DOCUMENTS

| | | | |
|---|---|---|---|
| 2,037,609 | 4/1936 | Vizcaino | 229/47 |
| 2,099,273 | 11/1937 | Myer | 52/DIG. 6 |
| 2,106,654 | 1/1938 | Poe | 52/DIG. 6 |
| 2,425,025 | 8/1947 | Boisselier | 85/13 |
| 2,968,395 | 1/1961 | Giebel | 206/448 |
| 3,043,488 | 7/1962 | Warwick | 206/448 |

*Primary Examiner*—William T. Dixson, Jr.

*Attorney, Agent, or Firm*—Lowe, Kokjer, Kircher, Wharton & Bowman

[57] ABSTRACT

A packaging arrangement which prevents damage to fragile articles such as automobile windshields and the like. Upper and lower slotted braces extend in pairs between opposite side walls of an outer shipping crate. The windshields are held in slots formed in the braces. A bracket plate having sharp teeth projecting in opposite directions therefrom is interposed between end flaps of the braces and the corresponding side walls of the crate. The teeth bite into the end flaps and side walls in order to anchor the braces in place relative to the crate. A tightly held strap extends along both braces in each pair and along the outside surfaces of both side walls of the crate in order to press the walls inwardly against the bracket plate. An alternative form of the bracket includes a horizontal flange having additional teeth which bite into the brace, along with a boss which resists twisting of the bracket.

14 Claims, 8 Drawing Figures

PACKAGING APPARATUS FOR FRAGILE ARTICLES

BACKGROUND AND SUMMARY OF THE INVENTION

This invention relates generally to the handling of fragile articles and deals more particularly with an improved packaging arrangement for objects such as windshields and the like.

The shipping of automobile windshields, curved rear windows, large panes of glass, and similar fragile articles has long posed a problem. The U.S. patent to Giebel, No. 2,968,395, typifies the manner in which the packaging of windshields and the like has been carried out in the past. The windshields are held at their upper and lower edges by slotted brace members which extend between the side walls of the outer shipping carton. The braces present cushions against which the edges of the windshields rest and which act as shock absorbers.

The primary problem with this type of packaging system has been the tendency of the braces to move relative to the outer container, thereby often resulting in breakage or other damage to the packaged objects. Typically, the braces are glued or stapled to the top and bottom panels of the shipping crate. These and the other types of fasteners that have been used are difficult and time consuming to apply and they also require additional supplies, resulting in significant increases in the overall cost. Further, the braces are permanently affixed to the crate and thus cannot be used interchangeably with different crates. Perhaps even more importantly, these and other conventional fasteners are highly susceptible to failure, most notably when large forces are exerted on the crates such as when they are dropped or otherwise roughly handled.

Another basic problem with existing packaging arrangements of this type is the failure of the braces to adequately grip the windshields. As a result, the windshields often slip with respect to the braces and are thus subjected to damage, particularly to the ends of the windshields. Although straps and the like have been used, they are not always capable of compressing the brace members sufficiently to assure that the windshields are firmly held in the slots of the braces. Also, the straps must be threaded by hand through internal channels of the braces, thereby causing further delays in the packaging operation and adding to the difficulty and expense.

An additional problem in the prior art has been the tendency to construct the packaging components for use with crates having only one specific size. Consequently, the components are capable of use only with windshields of a particular size and construction, and different packaging members must be designed and fabricated for each different size and shape of windshield that is to be shipped. Due to the wide variety in the sizes and styles of modern windshields and rear windows, this drawback has increased the shipping and handling costs to a significant extent.

In view of these and other deficiencies as to the manner in which windshields and other fragile articles have been packaged, it is apparent that a need remains for an improved packaging system for such articles. It is the primary goal of the present invention to meet that need.

More specifically, it is an important object of the invention to provide a packaging arrangement for fragile articles wherein the articles are firmly held in a fixed position within a shipping crate and are insulated from external forces that are applied to the crate.

Another object of the invention is to provide a packaging arrangement of the character described in which a crate of standardize size may be employed.

A further object of the invention is to provide a packaging arrangement of the character described having improved braces that are constructed in a manner to grip the windshields or other fragile articles more firmly than is the case with existing braces.

Still another object of the invention is to provide a packaging arrangement of the character described which can be quickly and easily assembled and which includes components that are economically produced and capable of repeated use.

An additional object of the invention is to provide, in a packaging arrangement of the character described, a bracket which is constructed in a unique fashion with teeth that serve to firmly secure the packaging components together.

Other and further objects of the invention, together with the features of novelty appurtenant thereto, will appear in the course of the following description of the drawings.

DETAILED DESCRIPTION OF THE INVENTION

In the accompanying drawings which form a part of the specification and are to be read in conjunction therewith, and in which like reference numerals are employed to indicate like parts in the various views.

Figure 1:
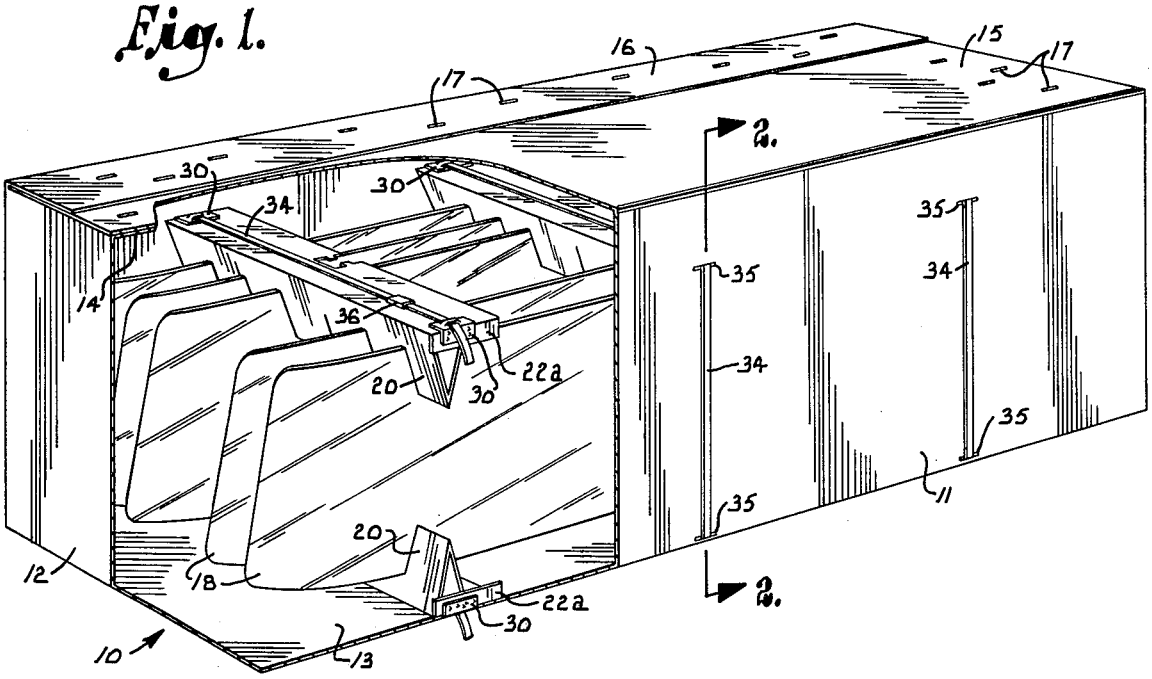
FIG. 1 is a perspective view illustrating a plurality of automobile windshields which are packaged according to a preferred embodiment of the present invention, with a portion of the outer shipping crate broken away for purposes of illustration.
Figure 2:
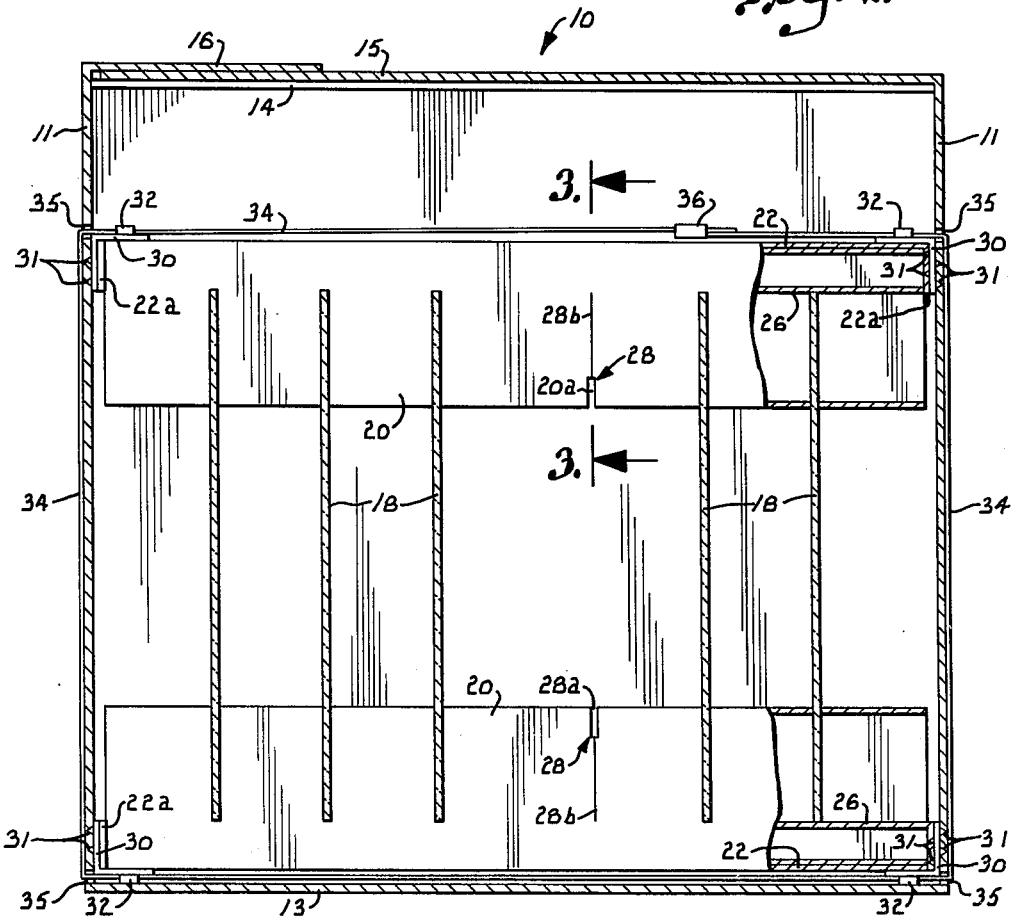
FIG. 2 is a sectional view on an enlarged scale taken generally along line 2—2 of FIG. 1 in the direction of the arrows, with portions of the brace members broken away to illustrate the internal details.

Referring now to the drawings in detail and initially to FIGS. 1 and 2, numeral 10 generally designates a shipping crate having opposite side walls 11, opposite end walls 12, and a bottom panel 13 which are interconnected with one another to provide a box like structure. The upper edges of the end walls 12 have flaps 14 which may be folded over beneath a large top panel 15 connected with the upper edge of one of the side walls 11. The opposite side wall has on its upper edge a smaller flap 16 which may be folded over on top of panel 15, which is large enough to substantially cover the top of the crate in order to enclose the contents. When the crate is closed, a plurality of staples 17 secures panel 15 to flaps 14 and 16. Crate 10 may be constructed of cardboard, paperboard or any other suitable substance.

Crate 10 serves as a shipping container for fragile articles such as curved windshields 18 of the type used on automobiles. The windshields 18 are held in parallel, spaced apart relation by upper and lower cross braces 20 which are generally triangular in section. Braces 20 are arranged in pairs with the braces on each pair spaced vertically apart at positions to receive the upper and lower edges of the windshields in a manner that will be described in more detail.

Figure 3:
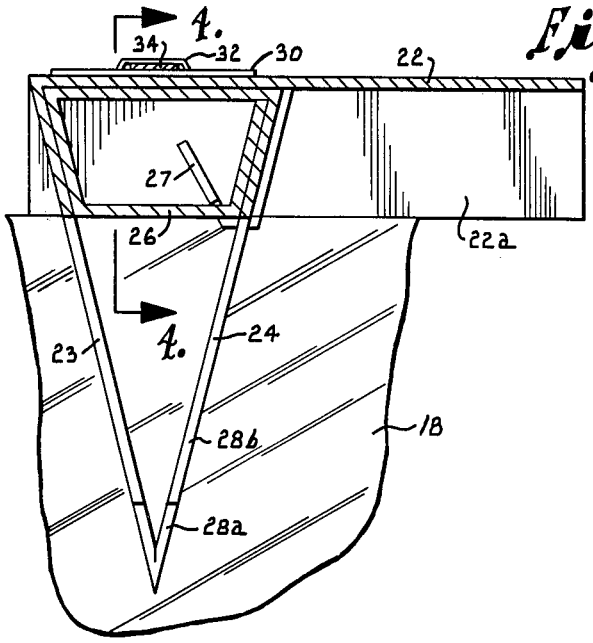
FIG. 3 is a fragmentary sectional view on an enlarged scale taken generally along line 3—3 of FIG. 2 in the direction of the arrows.

Each brace 20 is constructed identically; therefore, only one brace will be described in detail. With reference to FIG. 3, each brace 20 is formed from a single flat piece of any suitable material such as corrugated cardboard or paperboard. The triangular shape of the brace is obtained by bending the flat piece of material in a number of places. Each brace 20 includes a flat base panel 22 from which a wall 23 extends. At the apex of the triangle, another wall 24 extends at an acute angle from wall 23. Wall 24 extends back to panel 22 which projects well beyond the base of the triangle. As best shown in FIGS. 1 and 2, both ends of panel 22 extend beyond the edges of walls 23 and 24 to provide flaps **22*a*** that may be folded over against the wall edges.

Referring again to FIG. 3, the piece from which brace 20 is formed extends along the inside surface of panel 22 and also along the inside surface of wall 23 for a short distance. A flat panel 26 extending between walls 23 and 24 internally of the triangle structure is located well away from the apex of the triangle and is parallel to panel 22. A final section extends from the edge of panel 26 along the inside surface of wall 24. A tab 27 extending from a central location on panel 22 is inserted through an opening formed in wall 24 and panel 26. Tab 27 is notched in a manner to engage with the edges of the openings to thereby secure brace 20 in its final configuration.

Usually, two pairs of upper and lower braces 20 are sufficient, with one pair spaced inwardly of each end wall 12 of the shipping carton. However, three pairs of upper and lower braces may be provided as illustrated in FIG. 1, with the braces spaced substantially uniformly along the length of the crate and extending substantially between the side walls 12. The base panel 22 of the lower brace in each pair extends generally along the bottom carton panel 13, while the upper brace in each pair is located somewhat below the top of the crate in most cases.

Each brace 20 has a plurality of spaced apart slots 28 in which the edge portions of the windshields are received and held. With reference to FIG. 2 in particular, each slot is bifurcated such that presents a relatively short slot portion **28*a* cut into the apex of the triangle and having a width generally corresponding to the thickness of the windshield. A much thinner slit portion 28*b* is cut into the brace from the end of each slot 28*a*, providing essentially a continuation of the slot and terminating in the vicinity of panel 26. The edges bordering slot 29** may be displaced or spread apart such that the edge portion of the windshield may be received between them. However, the natural resiliency of the material and the resulting tendency of the bordering edges to press together exerts a compressive force on the windshield which provides a firm gripping action thereon.

Each brace 20 is secured to crate 10 by a pair of brackets 30 which are applied to the opposite ends of the brace. Each bracket 30 is formed identically and only one will be described in detail.

Figure 5:
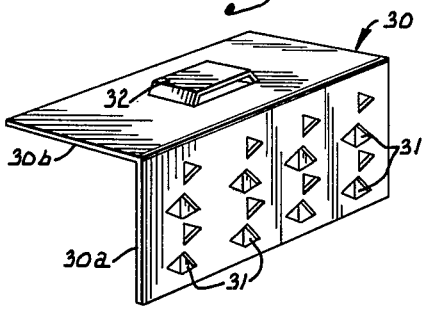
FIG. 5 is a perspective view of one of the brackets empolyed in the preferred embodiment of the invention.
Figure 4:
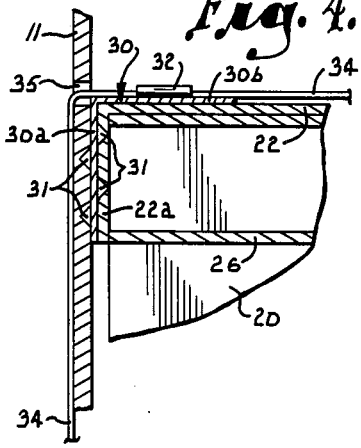
FIG. 4 is a fragmentary sectional view taken generally along line 4—4 of FIG. 3 in the direction of the arrows.

With particular reference to FIG. 5, each bracket 30 is constructed of metal or another hard substance which is formed to provide a pair of flat, plate like flanges **30*a* and 30*b*. The flanges extend at a right angle to one another such that the bracket has an L-shaped configuration. Flange 30*a* is oriented vertically when the bracket is used. A plurality of sharply pointed teeth 31 are punched or stamped from flange 30*a* and extend in both directions therefrom. A strip is punched outwardly from the horizontal flange 30*b* to provide an eyelet 32**.

Referring again to FIGS. 1 and 2, the eyelets 32 of brackets 30 receive an elongate metal band or strap 34 which is also extended through openings 35 that are either preformed in the side walls 11 or punched through the side walls with the ends of the strap. There is one strap 34 for each pair of upper and lower braces 20, and each strap is equipped with a conventional clamp 36 or another device that acts to secure the strap in a tight condition.

The packaging of windshields 18 in crate 10 is carried out by first extending straps 34 through the eyelets 32 of each pair of lower brackets 30 and also through each opposite pair of lower openings 35. The lower brace 30 of each pair is then positioned on the strap with brackets 30 positioned in the corners such that their vertical flanges **30*a* are sandwiched between each end flap 22*a* of the brace and the corresponding side wall 12 of the crate. The horizontal flange 30*b* is located between the base panel 22 of the brace and the bottom crate panel 13**.

After the lower braces 20 are all in place, the lower edges of the windshields 18 are inserted in the slots 28. The upper braces 20 are then installed such that the upper edges of the windshields are received in their slots 28. The upper brackets 30 are positioned with their vertical flanges **30*a* interposed between flaps 22*a* of the upper braces and the corresponding side walls 11. The horizontal flanges 30*b* of the upper brackets lie against the upper surface of panel 22**.

To complete the packing, each strap 34 is drawn upwardly along the outside surfaces of both side walls 11, and the ends of the strap are inserted through the upper openings 35 and the eyelets 32 of the upper brackets. The strap is then pulled tightly with its ends overlapped and is secured in a tense condition by clamp 36, which is preferably located on top of the upper brace 20. Finally, the upper flaps 14 and 16 and the upper panel 15 of the crate are folded to the closed position and stapled or otherwise secured to one another.

When the windshields are packed in this fashion, the teeth 31 of bracket 30 bite into both end flaps **22*a* of each brace 20 and also into both of the side walls 11 of the shipping carton. As a result, braces 20 are unable to shift in any direction relative to crate 10, and damage to the windshields is thereby avoided. Straps 34 act to press the side walls 11 inwardly toward the end flaps 22*a* in order to assure that teeth 31 remain embedded in the end flaps and in the side walls, Further, the straps exert compressive forces on brace 20 which, in cooperation with the natural tendency of the edges of slits 28*b*** to press together, firmly maintains the windshields in place and provides a gripping action which prevents them from slipping longitudinally.

It is thus evident that the windshields 18, braces 20, brackets 30, straps 34, and side walls 12 form a rigid unit and that relative movement between these members is precluded. The panels 26 which the edges of the windshields act against serve as cushions or shock absorbers that insulate the windshields from damage. It is noted that the upper brace 20 can be located well below the top of crate 10 and that the ends of the windshields are preferably spaced away from the end walls 12. Accordingly, a standard sized shipping crate large enough to hold the largest windshields can be employed since smaller windshields can be readily shipped therein when the packing arrangement provided by this invention is employed. It is further noted that the upper and lower runs of straps 34 extend along the outer surfaces of braces 20 and need not be threaded through the internal channels presented between panels 22 and 26.

Figure 6:
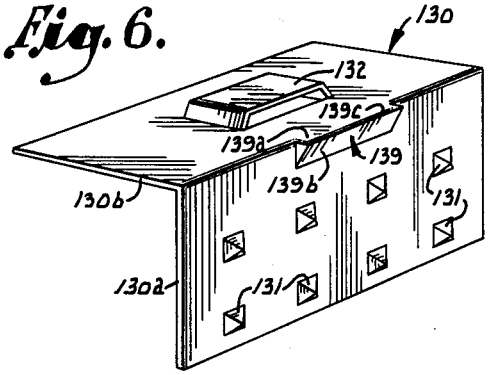
FIG. 6 is a perspective view illustrating a modified bracket that may be used in place of the bracket shown in FIG. 5.
Figure 7:
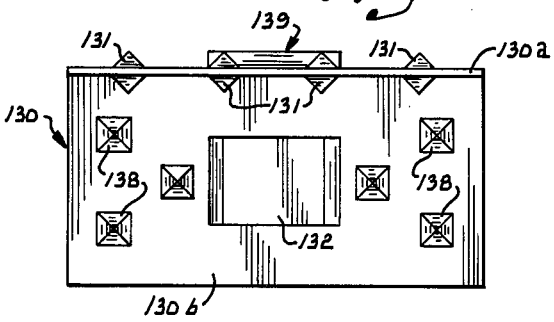
FIG. 7 is a bottom plan view of the bracket shown in FIG. 6.
Figure 8:
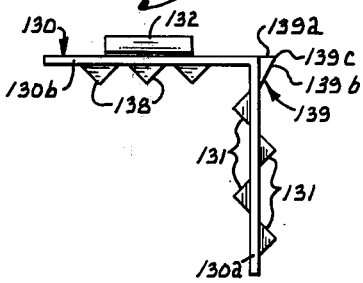
FIG. 8 is a side elevational view of the bracket shown in FIG. 6.

FIGS. 6–8 illustrate a modified bracket 130 which provides an alternative to the brackets 30 described previously. Brackets 130 are used in the same manner and in the same number as brackets 30, although they are preferably formed from a hard plastic substance rather than metal. Brackets 130 are each in the general shape of an "L", having flat plate-like flanges **130*a* and 130*b* which extend at a right angle to one another. Flange 130*a* is oriented vertically when the bracket is in use and is provided with teeth 131 which project in opposite directions from its opposite surfaces. The horizontal flange 130*b* has an eyelet 132 formed on its outer surface for receiving strap 34**.

Bracket 130 is provided with additional teeth 138 which project from the surface of flange **130*b* opposite the eyelet 132. In addition, a boss 139 is formed on flange 130*a*. Boss 139 extends a length equal to approximately $\frac{7}{8}$ of the total length of flange 130*a*, and it is located such that it presents a flat surface 139*a* that is coplanar with the corresponding surface of flange 130*b*. An inclined surface 139*b* of the boss joins surface 139*a* in a manner to form a sharp outer edge 139*c*** on the boss.

In use, bracket 130 is applied to braces 20 and the container side walls 11 in the same manner as described in connection with bracket 30, and its function is essentially the same. However, the additional teeth 38 bite into panel 122 in order to even more securely attach bracket 130 to brace 20. In addition, boss 139 acts to oppose any twisting movement that is applied to bracket 130 tending to dislodge it from the brace or container wall. Boss 139 is embedded in the side wall 11 or is received in opening 35 in the case of preformed openings. In any event, the flat surface **139*a* pushes against wall 11 in a manner to resist any counterclockwise twisting motion of the bracket (as viewed in FIG. 8). Surface 139*a* offers considerable resistance to twisting due to its relatively large surface area which is in contact with wall 11**.

Although the packing arrangement has been described in connection with the packing of windshields, it is to be understood that it is equally useful for packing other fragile articles such as the rear windows of automobiles, glass panes, and similar objects. Further, bracket 30 and 130 can be used with braces other than the braces 20 described herein.

From the foregoing it will be seen that this invention is one well adapted to attain all ends and objects hereinabove set forth together with the other advantages which are obvious and which are inherent to the structure.

It will be understood that certain features and subcombinations are of utility and may be employed without reference to other features and subcombinations. This is comtemplated by and is within the scope of the claims.

Since many possible embodiments may be made of the invention without departing from the scope thereof, it is to be understood that all matter herein set forth or shown in the accompanying drawings is to be interpreted as illustrative and not in a limiting sense.

Having thus described the invention, I claim:

1. Apparatus for packaging a fragile article, said apparatus comprising:

a rectangular, paperboard box container having a size sufficient to receive the article and presenting a plurality of interconnected walls;

a plurality of paperboard brace members arranged in spaced apart pairs and extending substantially between opposite walls of said container, each end of each said brace member having a planar end panel located inwardly of and substantially parallel to an adjacent corresponding wall of said container;

means on each brace member for receiving and holding a peripheral portion of the article;

a plurality of brackets disposed interiorly of said container, each said bracket having a plate portion, said plate portions being interposed between the respective end panels of said brace members and the interior surfaces of the adjacent corresponding walls of said container;

gripping means on said plate portion of each bracket for gripping the end panel and corresponding wall in a manner to substantially prevent relative movement between said brace members and container; and means urging said walls and panels generally toward one another and against the plate portions of said brackets.

2. Apparatus as set forth in claim 1, wherein said gripping means includes a plurality of teeth projecting in generally opposite directions from said plate portion of each bracket and biting into said end panels of the brace members and said corresponding walls of the container.

3. Apparatus as set forth in claim 1, wherein the receiving and holding means of each brace member comprises:

a slot formed in each brace member and having a width sufficient to receive an edge portion of the fragile article therein; and a slit formed in each brace member at a location to form a continuation of said slot, said slit being much narrower than said slot and being bordered by edges capable of being displaced sufficiently to receive said edge portion of the article therebetween, said edges tending to press together in opposition to their displacement in a manner to exert a gripping force on the fragile article.

4. Apparatus as set forth in claim 1, wherein:

said brace members extend substantially between opposite side walls of said container;

said panels are located on opposite ends of each brace member inwardly of the corresponding side walls of the container; and said urging means comprises an elongate strap extending generally along the outer surface of each side wall and tightened in a manner to urge said side walls inwardly toward the corresponding panels of said brace members.

5. Apparatus as set forth in claim 4, wherein said gripping means comprises a plurality of teeth projecting in generally opposite direction from said plate portion of each bracket and biting into said panels and side walls.

6. Apparatus as set forth in claim 5, wherein each bracket includes a second plate portion connected with the first mentioned plate portion and cooperating therewith to present a generally "L" shaped configuration, said second plate portions being disposed against the respective brace members.

7. Apparatus as set forth in claim 6, including a plurality of teeth projecting from said second plate portion of each bracket and biting into said brace members.

8. Apparatus as set forth in claim 6, including eyelet means on said second plate portion of each bracket for receiving said strap.

9. Apparatus as set forth in claim 6, including a projection extending generally outwardly from the first mentioned plate portion of each bracket, each projection presenting a surface thereon acting against the corresponding side wall of said container in a manner to resist twisting of the bracket with respect to said container.

10. Apparatus as set forth in claim 4, wherein said strap is arranged to extend along exterior surfaces of said brace members.

11. A bracket for anchoring a brace member within a container for fragile articles which are held by the brace member, said bracket comprising:

a first plate portion having opposite surfaces and adapted to be interposed closely between the brace member and container;

a second plate portion connected with said first plate portion and cooperating therewith to present a generally "L" shaped configuration; and a plurality of teeth projecting in generally opposite directions from the opposite surfaces of said first plate portion, said teeth being adapted to bite into said brace member and container in a manner to substantially prevent relative movement therebetween.

12. A bracket as set forth in claim 11, including a plurality of teeth projecting from said second plate portion and adapted to bite into said brace member.

13. A bracket as set forth in claim 11, including eyelet means on said second plate portion for receiving a strap member.

14. A bracket as set forth in claim 12, including a projection extending generally outwardly from said first plate portion, said projection presenting a surface thereon adapted to act against said container in a manner to resist twisting of the bracket relative to the container.

* * * * *